US009727002B2

(12) United States Patent
Iwayama et al.

(10) Patent No.: US 9,727,002 B2
(45) Date of Patent: Aug. 8, 2017

(54) IMAGE FORMING APPARATUS HAVING AN IMAGE BEARING MEMBER CHARGED WITH PREDETERMINED POLARITY AND POTENTIAL

(71) Applicant: CANON KABUSHIKI KAISHA, Tokyo (JP)

(72) Inventors: Hiroyoshi Iwayama, Yokohama (JP); Takashi Hiramatsu, Tokyo (JP); Akihisa Matsukawa, Fuchu (JP); Satoshi Sunahara, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/226,635

(22) Filed: Aug. 2, 2016

(65) Prior Publication Data

US 2016/0342104 A1 Nov. 24, 2016

Related U.S. Application Data

(63) Continuation of application No. 14/735,873, filed on Jun. 10, 2015, now Pat. No. 9,442,454.

(30) Foreign Application Priority Data

Jun. 13, 2014 (JP) ..... 2014-122708
Apr. 8, 2015 (JP) ..... 2015-079489

(51) Int. Cl.

| | |
|---|---|
| ***G03G 15/08*** | (2006.01) |
| ***G03G 21/00*** | (2006.01) |
| ***G03G 15/02*** | (2006.01) |
| ***G03G 21/10*** | (2006.01) |

(52) U.S. Cl.
CPC ..... *G03G 15/0266* (2013.01); *G03G 15/0216* (2013.01); *G03G 21/0064* (2013.01); *G03G 21/0094* (2013.01); *G03G 21/10* (2013.01)

(58) Field of Classification Search
CPC ..... G03G 15/0216; G03G 21/0094; G03G 21/0064; G03G 21/10
See application file for complete search history.

(56) References Cited

U.S. PATENT DOCUMENTS

| | | | | |
|---|---|---|---|---|
| 5,970,279 | A | 10/1999 | Sakaizawa | |
| 6,226,480 | B1 | 5/2001 | Hirabayashi | |
| 9,442,454 | B2 * | 9/2016 | Iwayama | G03G 21/0094 |

FOREIGN PATENT DOCUMENTS

| | | | |
|---|---|---|---|
| CN | 1610865 | A | 4/2005 |
| JP | H0736322 | A | 2/1995 |
| JP | 2001290339 | A | 10/2001 |
| JP | 2002207353 | A | 7/2002 |
| JP | 3332865 | B2 | 10/2002 |
| JP | 2013148756 | A | 8/2013 |

* cited by examiner

*Primary Examiner* — G. M. Hyder
(74) *Attorney, Agent, or Firm* — Canon U.S.A., Inc. IP Division

(57) ABSTRACT

Fluctuations in chargeability in an initial state are expected to be small. If a charging member is new, an image forming apparatus performs a supply operation for supplying a developer or a lubricant prior to an image forming operation in such a manner that the developer or the lubricant adheres to a surface of the charging member.

9 Claims, 10 Drawing Sheets

DEVELOPER SUPPLY OPERATION PRIOR TO IMAGE FORMING OPERATION

IMAGE FORMING OPERATION

FIG. 8

| | CHARGING MEMBER (V) | DEVELOPER BEARING MEMBER (V) | REGULATION MEMBER (V) | POTENTIAL DIFFERENCE (ΔV) = REGULATION MEMBER (V) − DEVELOPER BEARING MEMBER (V) |
|---|---|---|---|---|
| a: WHEN IMAGE IS FORMED | −1500 | −500 | −800 | −300 |
| b: BIAS OF REGULATION MEMBER IS CHANGED | −1500 | −500 | −500 | 0 |
| c: BIAS OF DEVELOPER BEARING MEMBER IS CHANGED | −1500 | −100 | −400 | −300 |
| d: BIAS OF CHARGING MEMBER IS CHANGED | −1800 | −500 | −800 | −300 |

DEVELOPER SUPPLY OPERATION PRIOR TO IMAGE FORMING OPERATION

IMAGE FORMING OPERATION

FIG. 10

| | CHARGING MEMBER (V) | DEVELOPER BEARING MEMBER (V) | REGULATION MEMBER (V) | POTENTIAL DIFFERENCE (ΔV) = REGULATION MEMBER (V) - DEVELOPER BEARING MEMBER (V) |
|---|---|---|---|---|
| a: WHEN IMAGE IS FORMED | -1500 | -500 | -800 | -300 |
| b1: BIAS OF REGULATION MEMBER IS CHANGED | -500 | +300 | +300 | 0 |
| c1: BIAS OF DEVELOPER BEARING MEMBER IS CHANGED | -500 | +700 | +400 | -300 |

IMAGE FORMING APPARATUS HAVING AN IMAGE BEARING MEMBER CHARGED WITH PREDETERMINED POLARITY AND POTENTIAL

The present application is a continuation of U.S. patent application Ser. No. 14/735,873, filed Jun. 10, 2015, entitled "IMAGE FORMING APPARATUS HAVING AN IMAGE BEARING MEMBER CHARGED WITH PREDETERMINED POLARITY AND POTENTIAL", the content of which is expressly incorporated by reference herein in its entirety. Further, the present application claims priority from Japanese Patent Applications No. 2014-122708, filed Jun. 13, 2014, and No. 2015-079489, filed Apr. 8, 2015, which are also hereby incorporated by reference herein in their entirety.

BACKGROUND OF THE INVENTION

Field of the Invention

The present invention relates to an image forming apparatus such as a copier and a printer for performing image formation by using image forming processes including a process by which an image bearing member such as an elecrophotographic photosensitive member or an electrostatic recording dielectric member is charged with a predetermined polarity and a predetermined potential.

Description of the Related Art

Conventionally, an image forming apparatus using an electrophotographic method often employs a process cartridge system. Such an image forming apparatus includes a cartridge that is attachable to and detachable from an apparatus main body thereof. The cartridge is integrally formed including a rotatable photosensitive member and a process unit acting upon the photosensitive member.

The use of the process cartridge system enables a user to perform maintenance work on the apparatus, which eliminates the necessity for maintenance work by a service person. This can markedly enhance operability. Thus, the process cartridge system has been widely used in the electrophotographic image forming apparatuses.

In the image forming apparatus such as a laser beam printer and a copier employing the electrophotographic method, a photosensitive member uniformly charged by a charging roller is first irradiated with light (e.g., laser beam) corresponding to image information to form an electrostatic latent image thereon. Subsequently, a developing device supplies developer (toner) to visualize the electrostatic latent image as a developed image (a toner image). The developed image is transferred from the photosensitive member onto a recording material such as a sheet, so that the image is formed on the recording material and then output.

The image forming apparatus employing such a transfer method may include a cleaner (a cleaning device) that removes residual transfer developer, which is remaining on the photosensitive member without being transferred to the recording material, from a surface of the photosensitive member. In such a case, the residual transfer developer is treated as waste developer. However, it is desired that the waste developer should not be generated from an environmental protection standpoint. Accordingly, there is an image forming apparatus in which a developing device performs "development and cleaning at the same time" without using a cleaner. More specifically, after a developed image is transferred from a photosensitive member, the developing device removes a residual transfer developer from a surface of the photosensitive member. The developing device collects the residual transfer developer, and reuses the collected developer. In other words, the image forming apparatus employs a developer recycling process.

The term "development and cleaning at the same time" used herein indicates a method for collecting developer remaining on a photosensitive member without being transferred to a recording material by using a residual toner collection bias when a next or subsequent development process is performed. More specifically, the method uses a fogging prevention potential difference Vback that is a potential difference between a direct current voltage applied to the developing device and a surface potential of the photosensitive member. According to this method, the developing device can collect the residual transfer developer, and reuse the collected residual transfer developer in the next or subsequent development process. This can eliminate waste developer and save maintenance work. Moreover, a so-called cleanerless image forming apparatus in which the residual transfer developer is collected by the developing device has an advantage in size. More specifically, since the image forming apparatus does not need to have the cleaning device, there is an advantage that size of the image forming apparatus can be markedly reduced.

In an image forming apparatus using a contact-type charging member (a charging roller), the charging member that contacts an image bearing member may pick up residual developer from a surface of the image bearing member. This may cause the residual developer to adhere to a surface of the charging member. Consequently, in a case where printing is repeatedly performed (durability), there is a possibility that chargeability may deteriorate due to an adhesion amount of the developer to the charging member.

Particularly, when the cleanerless image forming apparatus forms an image, residual transfer developer is liable to enter into a charging nip serving as a contact portion between the contact-type charging member and the image bearing member. This causes the developer to adhere to a surface of the contact-type charging member. In a case where there is developer on the contact-type charging member, a charging potential of the image bearing member varies depending on a developer adhesion amount. Such a phenomenon may appear as fluctuations in halftone image density.

Japanese Patent Application Laid-Open No. 2002-207353 discusses a method for stabilizing a charging potential while reducing fluctuations in chargeability. According to the method, charging accelerator and developer are mixed and applied beforehand to a new charging member. This reduces fluctuations in chargeability and stabilizes a charging potential when use of an apparatus is in initial state.

As for such a method, however, the admixture needs to be applied when the charging member is produced. This may lower productivity. In addition, there is a possibility that the applied admixture may drop onto an image forming apparatus or inside an apparatus body due to, for example, vibration during transport.

Accordingly, there has been a demand to reduce the fluctuations in the chargeability in the initial state without application of the admixture beforehand when the image forming apparatus is produced.

SUMMARY OF THE INVENTION

According to an aspect of the present invention, an image forming apparatus includes an image bearing member configured to bear a developer image, a charging member configured to contact the image bearing member, a transfer unit configured to transfer the developer image, and a developing unit configured to supply developer having a predetermined polarity to the image bearing member to form a developer image, and to collect developer remaining on the image bearing member after the developer image is transferred, wherein, in a case where the charging member is new, a supply operation for supplying developer or lubricant is performed prior to an image forming operation in such a manner that the developer or the lubricant having a polarity different from the predetermined polarity adheres to a surface of the charging member. If the charging member is new, a supply operation for supplying a developer or a lubricant is performed prior to an image forming operation such that the developer or the lubricant having a polarity different from the predetermined polarity adheres to a surface of the charging member.

Further features of the present invention will become apparent from the following description of exemplary embodiments with reference to the attached drawings.

BRIEF DESCRIPTION OF THE DRAWINGS

FIG. 8 is a diagram illustrating a bias relationship when the sequence according to the first exemplary embodiment is performed by changing biases of other members or units.

FIG. 10 is a diagram illustrating a bias relationship when a sequence according to the third exemplary embodiment is performed.

DESCRIPTION OF THE EMBODIMENTS

Various exemplary embodiments, features, and aspects of the invention will be described in detail below with reference to the drawings. Sizes, materials, shapes, and relative arrangements of components described in the exemplary embodiments should be selected as appropriate according to various conditions and configurations of an apparatus to which the present invention is applied. Thus, the scope of the present invention is not limited to the following exemplary embodiments.

(Cleanerless Image Forming Apparatus and Image Forming Process)

Figure 2:
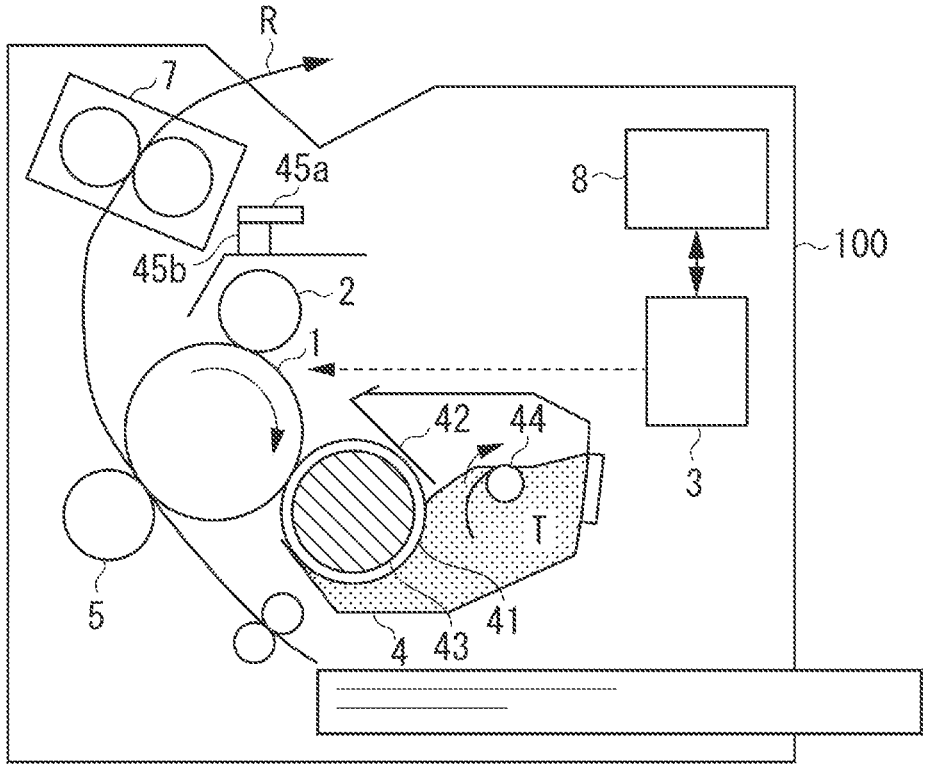
FIG. 2 is a diagram illustrating an image forming apparatus according to the first exemplary embodiment.

FIG. 2 is a diagram illustrating a schematic configuration of a printer 100 serving as an image forming apparatus according to a first exemplary embodiment of the present invention. The diagram illustrated in FIG. 2 is a sectional view as seen along an axial direction of an image bearing member in a normally installed state. In FIG. 2, a direction from the top to the bottom represents a vertical direction, whereas a direction from the right to the left represents a horizontal direction.

In the present exemplary embodiment, the printer 100 includes a photosensitive drum 1 serving as an image bearing member and a charging roller 2 serving as a charging member. The photosensitive drum 1 and the charging roller 2 form an image bearing member unit. Moreover, the printer 100 includes a developing device (a developing unit) 4. The developing device 4 includes at least a developing sleeve (a developing roller) serving as a developer bearing member, and a development frame member in which developer is stored. The developing device 4 is attachable to and detachable from an apparatus body of the printer 100. However, the configuration is not limited thereto. The image bearing member unit may also be attachable to and detachable from the apparatus body of the printer 100. Moreover, the image bearing member unit and the developing unit may be integrally formed to be a process cartridge. The process cartridge may also be detachable from the apparatus body of the printer 100.

An image forming operation is described below with reference to FIGS. 2 and 3.

When the printer 100 starts an image forming operation, the photosensitive drum 1 serving as the image bearing member is rotationally driven by a drive motor at a circumferential speed of 150 mm/sec in a direction indicated by an arrow illustrated in FIG. 2.

The printer 100 uses the charging roller 2 serving as the charging member to charge a surface of the photosensitive drum 1. The printer 100 performs processing for stabilizing a charging potential prior to the image forming operation described below.

Figure 3:
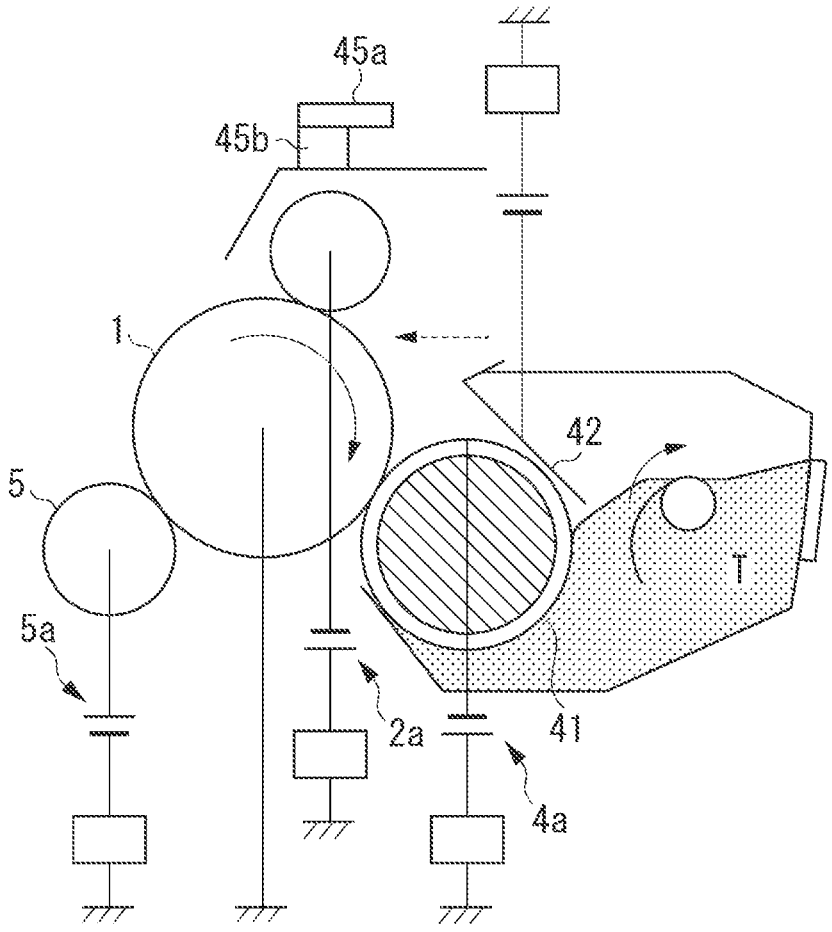
FIG. 3 is an enlarged view illustrating one portion of the image forming apparatus according to the first exemplary embodiment.

The charging roller 2 receives a voltage (Vpri) of −1500V at a predetermined timing from a charging power supply 2*a* illustrated in FIG. 3, so that the surface of the photosensitive drum 1 is uniformly charged with −800V.

A laser exposure unit 3 serving as an exposure device irradiates the charged photosensitive drum 1 with laser beam according to image data. The photosensitive drum 1 is repeatedly irradiated with the laser beam in a main scanning direction (a photosensitive member rotation axis direction) and a sub-scanning direction (a photosensitive member surface movement direction). This forms an electrostatic latent image on the photosensitive drum 1.

The developing device 4 serving as the developing unit is detachably disposed to the apparatus body of the printer 100. The developing device 4 can be replaced with new one when the lifetime thereof ends. The developing device 4 can develop the electrostatic latent image formed on the photosensitive drum 1 by using a developing sleeve 41 to which a developing bias (Vdc) of −500V is applied from a developing bias power supply 4*a* illustrated in FIG. 3.

The developing device 4 is described below. The developing sleeve 41 is rotatably supported by the developing device 4, and rotationally driven at a circumferential speed of 140% with respect to that of the photosensitive drum 1. The developing sleeve 41 is formed of an aluminum hollow tube and a conductive elastic rubber layer formed around the hollow tube. The conductive elastic rubber layer has a surface roughness Ra of 1.0 μm to 2.0 μm to convey developer. The developing sleeve 41 includes therein a magnet roller 43 serving as a magnet. The magnet roller 43 is fixed to the developing sleeve 41. In the developing device 4, an agitation member 44 agitates magnetic one-component black developer T (negative charge characteristic) serving as a developer. Such agitation enables the developer to be supplied to a surface of the developing sleeve 41 with magnetic force of the magnet roller 43 inside the developing device 4. The developer supplied to the surface of the developing sleeve 41 passes through a developing blade 42 serving as a regulation member for regulating a thickness of a developer layer. Upon passing through the developing blade 42, the developer is regulated into a uniform thin layer and triboelectrically charged with a negative polarity. Subsequently, the developer is conveyed to a development position at which the developer contacts the photosensitive drum 1, thereby developing the electrostatic latent image on the photosensitive drum 1.

The developed image (i.e., visualized image) on the photosensitive drum 1 is further conveyed to a contact portion of a transfer roller 5 serving as a transfer unit, and is transferred onto a recording material R conveyed in synchronization with the developed image. A transfer bias is applied between the transfer roller 5 and the photosensitive drum 1 by a power supply 5*a* illustrated in FIG. 3.

The recording material R onto which the developed image has been transferred is conveyed to a fixing device 7. In the fixing device 7, heat and pressure are applied to the recording material R onto which the developed image has been transferred, thereby fixing the transferred developed image on the recording material R.

Meanwhile, after the developed image is transferred, residual transfer developer remaining on the photosensitive drum 1 without being transferred onto the recording material R is conveyed toward the charging roller 2. At this time, a voltage (−1500V) for charging the photosensitive drum 1 is being applied to the charging roller 2. When the residual transfer developer is conveyed near a nip portion, the photosensitive drum 1 and most of the residual transfer developer are negatively charged by a discharge of the electric charge from the charging roller 2. As a result, since most of the residual transfer developer is negatively charged in a forcible manner, there is an electric field between the charging roller 2 and the negatively charged photosensitive drum 1. The electric field enables the residual transfer developer to pass through the charging roller 2 without adhering to the charging roller 2. Although most of the developer is charged with the negative polarity by the discharge of electric charge from the charging roller 2 as described above, a small amount of the developer is not charged with the negative polarity. Such a developer may adhere to the charging roller 2. To suppress such an adhesion of the developer, a gear rotates the charging roller 2 in the same direction as the photosensitive drum 1 at a circumferential speed of 110%, with respect to that of the photosensitive drum 1, so that the charging roller 2 is rotationally driven at a higher circumferential speed than the photosensitive drum 1. In this way, the developer is negatively charged by friction between the charging roller 2 and the photosensitive drum 1, and returned to the photosensitive drum 1 by the electric field. A circumferential speed of the charging roller 2 serving as the charging member is desirably set from 110% to 140%. Hence, an adhesion amount of the developer to the charging roller 2 is usually reduced by negatively charging the developer by the discharge of electric charge from the charging roller 2 and by the friction generated by the circumferential speed difference.

After passing through the charging roller 2, the residual transfer developer is conveyed to a development position along with the rotation of the photosensitive drum 1. In this state, a potential difference (Vback) in a non-image forming portion is −300V, where a dark area potential (Vd) on the surface of the photosensitive drum 1 is −800V, and a developing bias (Vdc) is −500V. Thus, the residual transfer developer adheres to the developing sleeve 41, and is collected into the developing device 4. This is called "development and cleaning at the same time". However, the development and the cleaning do not need to be performed precisely at the same time. In an image forming portion, the developer does not adhere to the developing sleeve 41 as there is an electric field generated by a light area potential (V1) of −100V on the surface of the photosensitive drum 1 and a developing bias (Vdc) of −500V. However, since an image is supposed to be formed in the image forming portion, the developer remains on the photosensitive drum 1 and is later transferred. Such processing is repeated to execute the image forming operation.

In the present exemplary embodiment, the image forming operation includes a rotation operation such as a pre-rotation and a post-rotation performed in a normal image forming operation.

Figure 4:
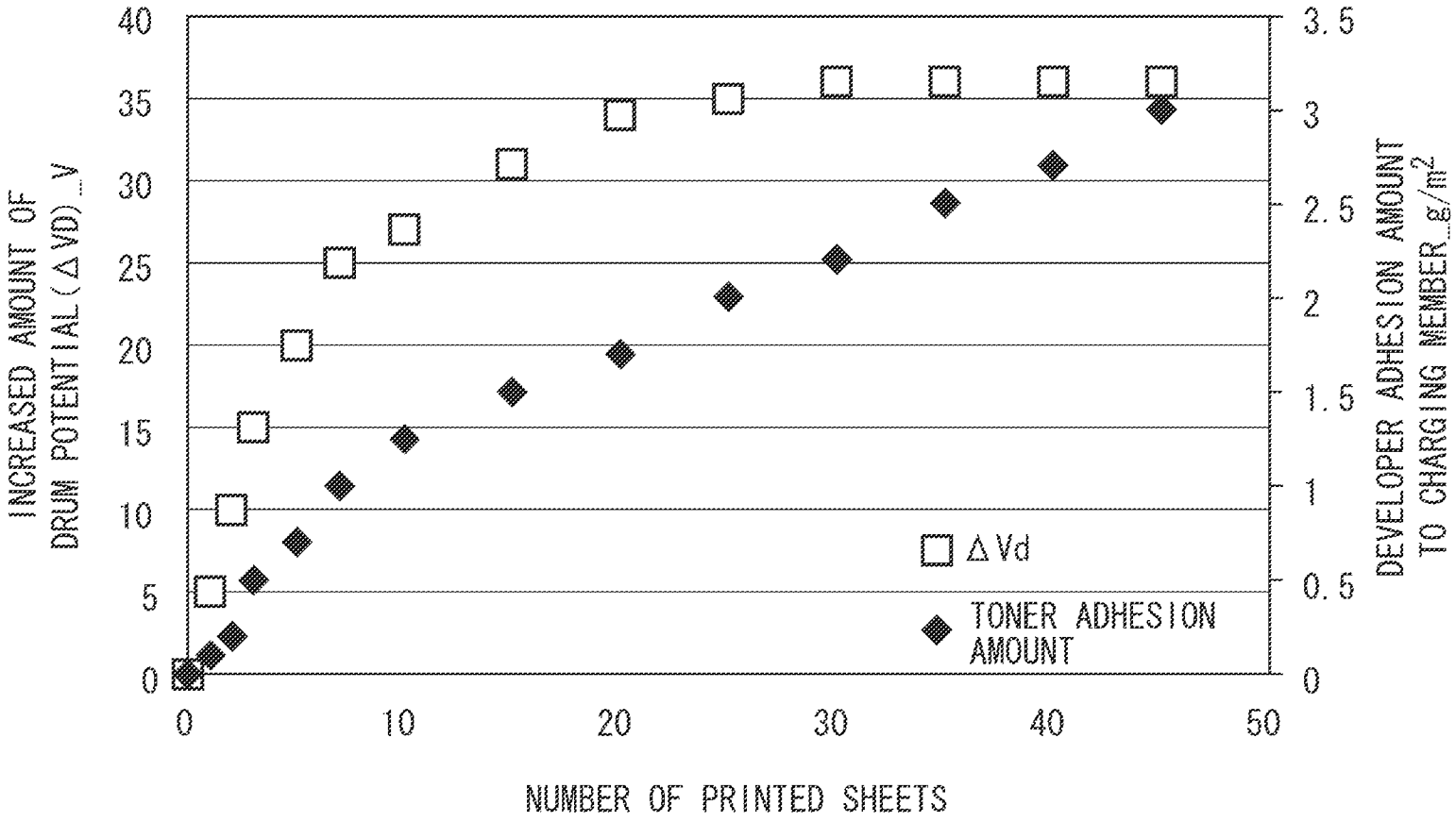
FIG. 4 is a diagram illustrating a relationship between an adhesion amount of developer to a charging member and a charging potential of an image bearing member.
Figure 5:
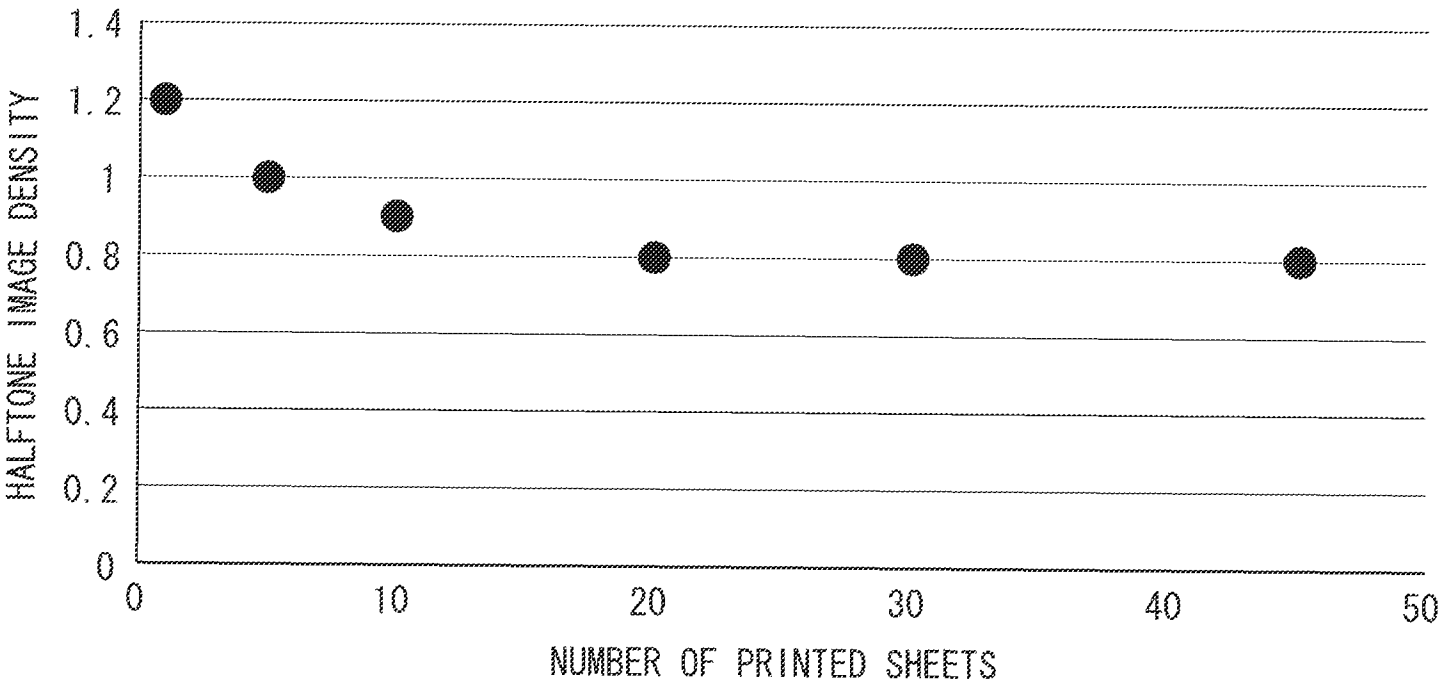
FIG. 5 is a diagram illustrating a relationship between a halftone image density and a number of printed sheets when the sequence according to the first exemplary embodiment is not performed.

A potential of a photosensitive drum serving as an image bearing member may be affected depending on an adhesion amount of the developer to a charging member. As illustrated in FIG. 4, when an adhesion amount of the developer to a new charging member increases, a dark area potential (Vd) on a surface of the photosensitive drum increases. When the adhesion amount of the developer to the charging member reaches 2 $g/m^2$ or greater, chargeability becomes stable, and thus the potential of the photosensitive drum serving as the image bearing member becomes stable. Thereafter, even when the adhesion amount of the developer to the charging member further increases, the potential of the photosensitive drum remains at a constant level. For example, when the adhesion amount of the developer to the charging member is from 2 $g/m^2$ or greater to 3 $g/m^2$ or less, an increased amount of the potential of the photosensitive drum is constant. This indicates that the potential of the photosensitive drum is stable. Moreover, when the adhesion amount of the developer to the charging member is further increased, an increased amount of the potential of the photosensitive drum starts to decrease gradually. On the other hand, if developer adheres to a new charging member to which nothing has adhered, a potential difference Vback from a developing bias (Vdc) increases. This causes fluctuations in halftone image density. In a conventional case as illustrated in FIG. 5, a halftone image density gradually decreases from an initial state, and becomes a steady value when the number of printed sheets reaches 20.

In the above-described drive configuration of the charging roller serving as the charging member, there is no particle interposed in the charging roller in an initial state (new), in particular. Hence, the frictional resistance to the photosensitive drum is high, and thus the driving torque is high. Consequently, the drive motor of the apparatus body needs to be changed to a high-power motor to stably drive the charging member. Such a change may further increase costs.

(Configuration of the Present Exemplary Embodiment)

In the present exemplary embodiment, a sequence is performed so that a certain amount of developer adheres to a new charging member prior to an image forming operation. With the sequence, a drum potential (Vd) is appropriately controlled. Herein, such a sequence is also called a supply operation by which a developer is supplied in such a manner that the developer adheres to the charging member. Moreover, the sequence is performed by a signal processing unit such as a central processing unit (CPU).

In the present exemplary embodiment, the apparatus body of the printer 100 and a charging device respectively include a memory 45*a* and a memory 45*b* each serving as a storage unit. Data and information can be written into and read from these memories 45*a* and 45*b* whenever necessary. A non-volatile memory can store data even when the printer 100 is turned off. In the present exemplary embodiment, the non-volatile memory 45*b* stores a number of printed sheets of the charging device as history information of the charging device, whereas the memory 45*a* stores the history information of the charging device when the printer 100 is turned on or in a standby state. A state of the charging device or the charging member is determined based on the history information. For example, if the number of printed sheets is zero, it is determined that the charging device or the charging member is new.

Figure 1:
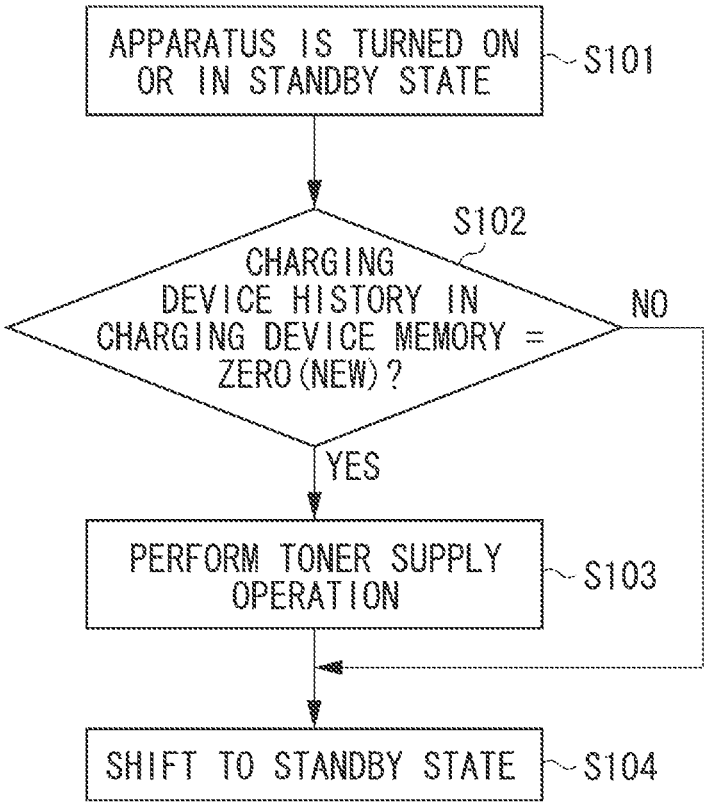
FIG. 1 is a sequence diagram illustrating a sequence according to a first exemplary embodiment.

The sequence according to the present exemplary embodiment is described with reference to FIG. 1.

In step S101, the printer 100 serving as an image forming apparatus is turned on or in a standby state. In step S102, the CPU reads the memory 45*b* of the charging device to determine whether usage history information (hereinafter, referred to as charge history) of the charging device or the charging member indicates zero (0 sheet). In other words, the CPU determines whether the charging device or the charging member is new. If the charge history does not indicate zero (NO in step S102), the sequence proceeds to step S104. In step S104, the printer 100 shifts to the standby state. If the charge history indicates zero (YES in step S102), the CPU determines that the charging member is new, and the sequence proceeds to step S103. In step S103, the CPU performs the sequence for causing a certain amount of developer to adhere to the charging roller 2 serving as the charging member. Thereafter, in step S104, the printer 100 shifts to the standby state, and performs a normal image forming operation.

Figure 6A:
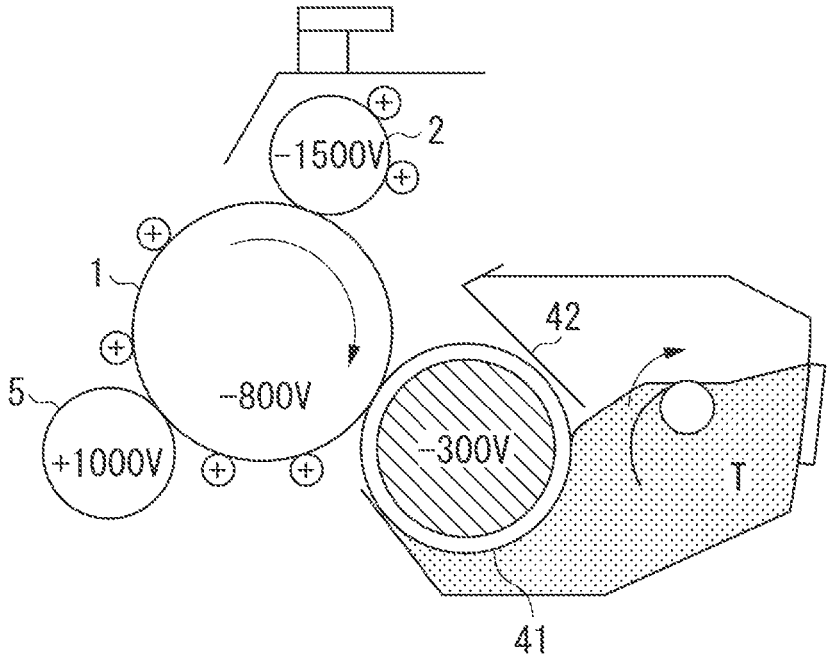
FIG. 6A is a diagram illustrating a developer supply operation performed prior to an image forming operation.
Figure 6B:
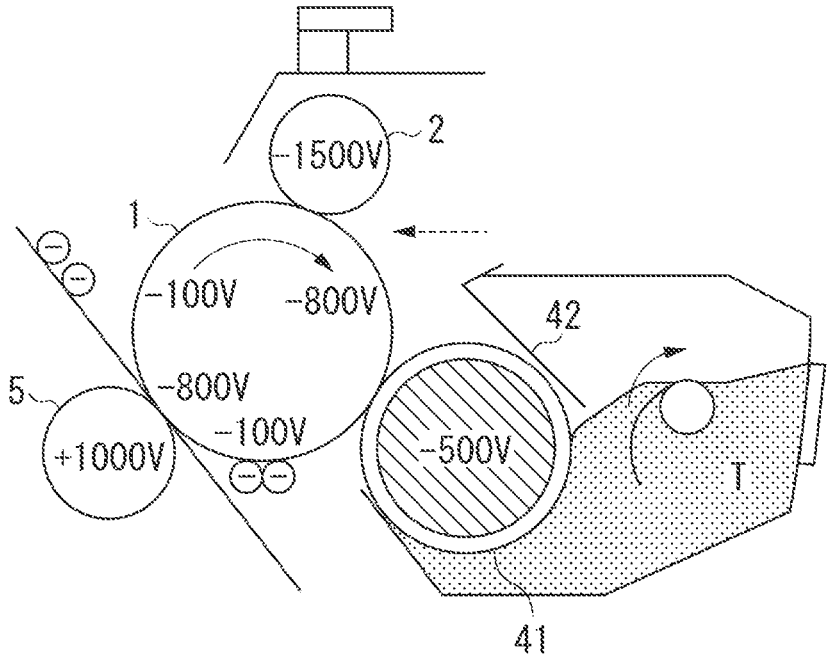
FIG. 6B is a diagram illustrating the image forming operation.

The sequence performed in step S103 is described in detail. In the present exemplary embodiment, a developing bias (Vdc) is set to −300V which is lower than that in the normal image forming operation (−500V) in terms of absolute values. In other words, the Vback is increased to −500V from that in the image forming operation to drive the charging member, thereby executing the sequence (FIG. 6A). In the sequence, the charging member is driven for 10 seconds. This causes a larger amount of fogging developer than that in the normal image formation to adhere to the charging member before the image forming operation is performed (FIG. 6A). Herein, the fogging developer is a developer charged with a polarity different from that of a developer used to develop an electrostatic image (or an electrostatic latent image) on the photosensitive drum 1 to form a developed image. Assuming that a developer having a predetermined polarity for formation of a developed image is normally charged (negatively charged in the present exemplary embodiment), the fogging developer is oppositely charged (positively charged in the present exemplary embodiment), and has characteristics to adhere to the charging member with higher efficiency. Moreover, in the present exemplary embodiment, particles having a polarity different from that in the development are caused to adhere to the charging member, so that an amount of the particles having the different polarity is increased on a surface of the charging member.

When the sequence is performed for 10 seconds, the photosensitive drum 1, the charging roller 2, and the developing roller rotate 24 times, 58 times, and 61 times, respectively.

Such a sequence is performed in the following conditions. A process speed is 150 mm/s, the photosensitive drum 1 has a diameter Φ of 20 mm, the charging roller 2 serving as the charging member has a diameter Φ of 9 mm, and the developing roller serving as a developer bearing member has a diameter Φ of 11 mm. The charging roller serving as the charging member and the developing roller serving as the developer bearing member are rotationally driven at circumferential speeds of 110% and 140%, respectively, with respect to that of the photosensitive drum 1.

Table 1 illustrates a relationship between fluctuations of halftone image density (also referred to as HT density), toner adhesion amount, and the number of printed sheets.

In Table 1, an exemplary embodiment 1-1 indicates a case where the aforementioned sequence was performed, whereas a conventional example indicates a case where the sequence of the present exemplary embodiment was not performed. In other words, in the conventional example, a normal image forming operation was performed without a supply operation prior to the image forming operation. Moreover, in Table 1, an exemplary embodiment 1-2 indicates a case where a developing bias (Vdc) at the time of performing the sequence was set to −500V. In other words, the Vback was set to −300V which was the same as that in the normal image forming operation, and components such as the charging member and the photosensitive drum 1 were driven without exposure processing.

TABLE 1

| | | CONVENTIONAL EXAMPLE | | EXEMPLARY EMBODIMENT 1-2 | | EXEMPLARY EMBODIMENT 1-1 | |
|---|---|---|---|---|---|---|---|
| | | SEQ TIME | | | | | |
| | | NONE (0 SEC) | | 10 SECONDS | | 10 SECONDS | |
| | SETTING ITEM | HT DENSITY | ADHESION AMOUNT g/m2 | HT DENSITY | ADHESION AMOUNT | HT DENSITY | ADHESION AMOUNT |
| NUMBER OF PRINTED SHEETS | 1 | 1.2 | 0.1 | 1 | 0.7 | 0.8 | 1.7 |
| | 5 | 1 | 1 | 0.9 | 1 | 0.8 | 2 |
| | 10 | 0.9 | 1.25 | 0.8 | 1.5 | 0.8 | 2.2 |
| | 20 | 0.8 | 1.7 | 0.8 | 1.7 | 0.8 | 2.7 |
| | 30 | 0.8 | 2.2 | 0.8 | 2.2 | 0.8 | 3 |

In the conventional example, a printer needed to print approximately 20 pages before halftone image density became stable. On the other hand, in the exemplary embodiment 1-1, halftone image density was stable from an initial state. Even in a potential setting as the exemplary embodiment 1-2, a drum potential became stable when 10 pages were printed, which was faster than the conventional example. Accordingly, each of the exemplary embodiments 1-1 and 1-2 indicated that adhesion of an appropriate amount of toner to the charging member reduced fluctuations in chargeability in an initial state and stabilized the chargeability in comparison with the conventional example. Moreover, in the exemplary embodiment 1-1, not only output images were stabilized, but also driving torque was reduced. It is conceivable that the developer functioned as a lubricant in a contact portion between the charging roller 2 and the photosensitive drum 1.

In the present exemplary embodiment, the developing bias (Vdc) is changed to have a large Vback. However, a charging bias (Vpri) applied to the charging member or a transfer bias applied to the transfer member may be changed. Further, a voltage (a blade bias) may be applied to the developing blade 42 serving as the regulation member, so that a fogging developer adheres to the charging member. Moreover, a plurality of biases may be changed to execute the sequence of developer supply operation. For example, the developing bias and the blade bias may be simultaneously changed to cause the fogging developer to efficiently adhere to the charging member.

In other words, in any of the developer bearing member, the charging member, the transfer unit, and the regulation member, a voltage applied in the image forming operation is desirably different from a voltage applied in the developer supply operation for causing a developer to adhere to the charging member. For example, as illustrated in FIG. 8, when a bias is set, a fogging developer adheres to a new charging member. In a case "b" in an example table illustrated in FIG. 8, a blade bias of the developing blade serving as a regulation member may be changed. If the bias of the developing blade is close to a bias of the developing roller (developing unit), fogging developer tends to occur. In the case "b", the biases of the developing blade and the developing roller are at the same potential, and the fogging developer occurs. Moreover, the bias of the developing roller may be changed to −100V as illustrated in a case "c". In such a case, a potential difference (ΔV) is −300V which is the same as when an image is formed in a case "a" illustrated in FIG. 8. However, since the possibility of fogging developer occurring increases with an increase in Vback, the fogging toner tends to occur in the case "c".

As described in the exemplary embodiment 1-2, the same voltage (bias) as that used in the image forming operation may be applied to the developer bearing member, the charging member, and the regulation member. In such a case, a certain amount of fogging developer adheres to the charging roller if the charging roller is driven without exposure processing. Hence, a certain effect is achieved.

Moreover, in the present exemplary embodiment, a fogging developer is supplied to the charging member so that developer efficiently adheres to the charging member. However, developer (normally charged developer) used in the normal image formation may be used. In such a case, a similar effect can be achieved by prolonging a sequence time and reducing the charging bias (Vpri) to be lower than the drum potential (Vd). Herein, it is desired that a voltage not be applied to the transfer roller serving as the transfer unit, or the photosensitive drum be separated from the transfer roller. In the present exemplary embodiment, the printer 100 serving as the image forming apparatus includes a contact and separation mechanism for causing the developing roller serving as the developer bearing member and the photosensitive drum serving as the image bearing member to contact each other and to be separated from each other. Thus, when the printer 100 is new, the developing roller and the photosensitive drum are not in contact with each other. The sequence according to the present exemplary embodiment starts after the developing roller and the photosensitive drum contact each other. However, the present exemplary embodiment is not limited thereto. The present exemplary embodiment may be applied to an apparatus in which a developing roller and an image bearing member are in contact with each other from an initial state.

Further, there are cases where the developing roller and the developing blade have been coated with a lubricant other than the developer to reduce an initial driving torque. A coating agent includes TOSPEARL and phenol resin in addition to the developer. In the present exemplary embodiment, the operation for supplying the developer has been described. However, the present exemplary embodiment is not limited to the developer supply operation. The present exemplary embodiment may be applied to an operation for supplying the aforementioned coating agent. In such a case, a similar effect can be achieved.

Moreover, the present exemplary embodiment has been described using the configuration including the detection unit for detecting a new charging unit. However, in a case where an image forming apparatus does not include such a detection unit, the image forming apparatus may determine whether the charging unit is replaced based on door opening and closing of an apparatus body. If the image forming apparatus determines that the charging device is replaced, the above-described sequence is performed.

A second exemplary embodiment is described. In the present exemplary embodiment, a sequence time similar to the above exemplary embodiment 1-1 is optimized according to the environment.

In the present exemplary embodiment, moreover, a memory 45*b* serving as a storage unit disposed in a charging device stores temperature and humidity information as usage environment in addition to information about the number of printed sheets. Generally, an adhesion speed of developer to a charging member is lowered in environment with high temperature and high humidity. Thus, a sequence time necessary to stabilize halftone image density needs to be longer in such an environment.

In the present exemplary embodiment, a sequence time is determined by using the temperature and humidity information. The sequence time determined in the present exemplary embodiment is more appropriate than that in the exemplary embodiment 1-1. In the present exemplary embodiment, a CPU serving as a computation unit determined a sequence time T (second)−α×T0 (second), where α is a temperature and humidity correction coefficient illustrated in Table 2, and T0 is a sequence time of the exemplary embodiment 1-1 (i.e., 10 seconds according to the exemplary embodiment 1-1). However, the correction method using the temperature and humidity history is not limited thereto.

TABLE 2

| | | HUMIDITY % | | | | | |
|---|---|---|---|---|---|---|---|
| | α | 0 | 20 | 40 | 60 | 80 | 100 |
| TEMPERATURE ° C. | 40 | 0.9 | 1 | 1.2 | 1.5 | 1.7 | 2 |
| | 30 | 0.8 | 0.9 | 1 | 1.2 | 1.5 | 1.7 |
| | 20 | 0.7 | 0.8 | 0.9 | 1 | 0.8 | 1.5 |
| | 10 | 0.6 | 0.7 | 0.8 | 0.9 | 1 | 2.7 |
| | 0 | 0.5 | 0.6 | 0.7 | 0.8 | 0.9 | 1 |

In the present exemplary embodiment, an image output result acquired at a room temperature of 40° C. and a humidity of 90% is illustrated together with that of the exemplary embodiment 1-1. When the room temperature is 40° C. and the humidity is 90%, the temperature and humidity correction coefficient α is 1.85. The sequence time T (second)=1.85×10=18.5(second). Therefore, the sequence time is 18.5 seconds.

TABLE 3

| | | EXEMPLARY EMBODIMENT 1-1 | | EXEMPLARY EMBODIMENT 2 | |
|---|---|---|---|---|---|
| | | HT DENSITY | ADHESION AMOUNT g/m2 | HT DENSITY | ADHESION AMOUNT |
| NUMBER OF PRINTED SHEETS | 1 | 1.1 | 0.6 | 0.8 | 1.7 |
| | 5 | 0.9 | 1 | 0.8 | 2 |
| | 10 | 0.8 | 1.6 | 0.8 | 2.2 |
| | 20 | 0.8 | 2 | 0.8 | 2.7 |
| | 30 | 0.8 | 2.5 | 0.8 | 3 |

In the exemplary embodiment 1-1, a good result was not acquired under the environment with the room temperature of 40° C. and the humidity of 90%. A halftone image density became stable at a certain value when approximately 10th sheet was printed from beginning of the image printing. In the present exemplary embodiment, on the other hand, an image density was stable from the beginning of the image printing.

Accordingly, a change in the sequence time according to the usage environment can provide a more suitable effect.

In the present exemplary embodiment, the sequence (supply operation) time is changed. Alternatively, a charging bias applied to the charging member or a developing bias applied to the developing sleeve during the supply operation may be changed.

In the present exemplary embodiment, moreover, the sequence time is changed by using the temperature and humidity correction coefficient based on the temperature and humidity information. However, one of temperature information and humidity information may be acquired, so that a sequence time is calculated based on the acquired information. For example, information about temperature inside the image forming apparatus (particularly, information about temperature near the charging member) may be acquired, so that a sequence time is calculated based on the acquired temperature information. Alternatively, a sequence time may be calculated based on humidity information.

(Other)

Figure 7:
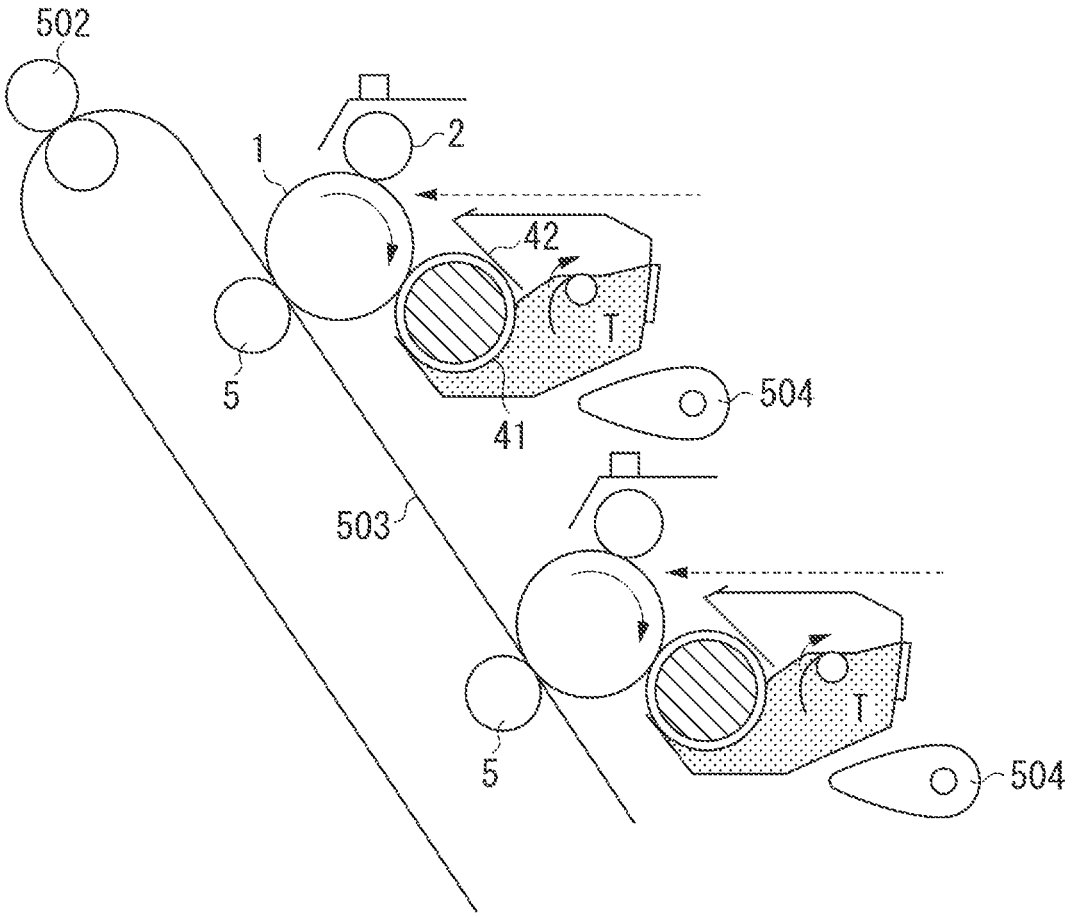
FIG. 7 is a schematic diagram illustrating an image forming apparatus including a plurality of image bearing members.

The image forming apparatus for forming an image with one photosensitive drum has been described above. However, the image forming apparatus is not limited thereto. For example, as illustrated in FIG. 7, each of the exemplary embodiments may be applied to an image forming apparatus including a plurality of photosensitive drums 1. In FIG. 7, the image forming apparatus includes a transfer unit 5 for transferring developer from the photosensitive drum 1 to a belt 503 serving as an intermediate transfer member. Moreover, the image forming apparatus includes a secondary transfer unit 502 for transferring the developer transferred to the intermediate transfer member to a recording material. The image forming apparatus also includes a contact and separation mechanism 504 serving as a cam. The contact and separation mechanism 504 causes a developing roller and the photosensitive drum 1 to contact each other and to be separated from each other.

An image forming apparatus according to a third exemplary embodiment is described. A configuration of the image forming apparatus according to the present exemplary embodiment is similar to that of the first exemplary embodiment.

In a case where a charging roller is rotationally driven at circumferential speed without a coating agent applied thereto similar to the first and second exemplary embodiments, large friction is generated between a charging member and an image bearing member in an initial state due to absence of developer on a contact surface therebetween. If the charging member discharges to the image bearing member, the friction is further increased by the influence exerted by a discharge product. In such a state, rotation of the charging member may damage a surface layer of the charging member.

Figure 9A:
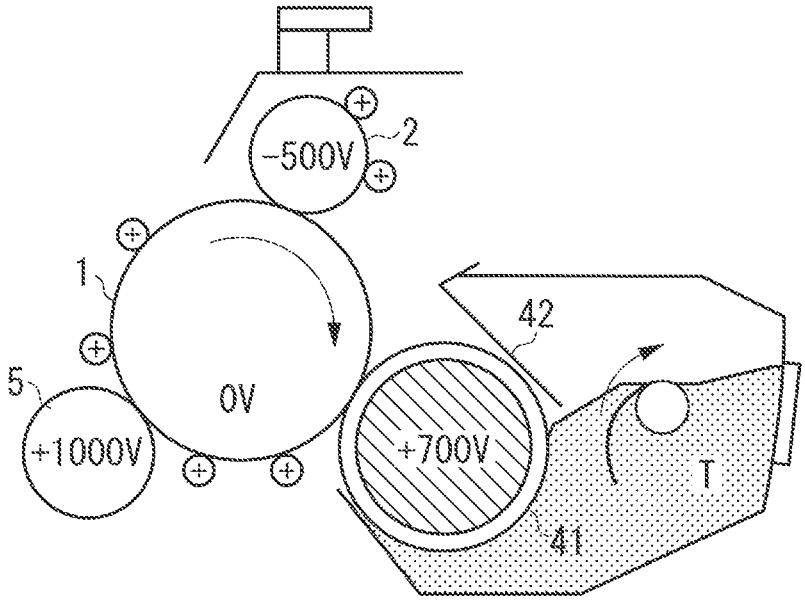
FIG. 9A is a diagram illustrating a developer supply operation performed prior to an image forming operation according to a third exemplary embodiment.
Figure 9B:
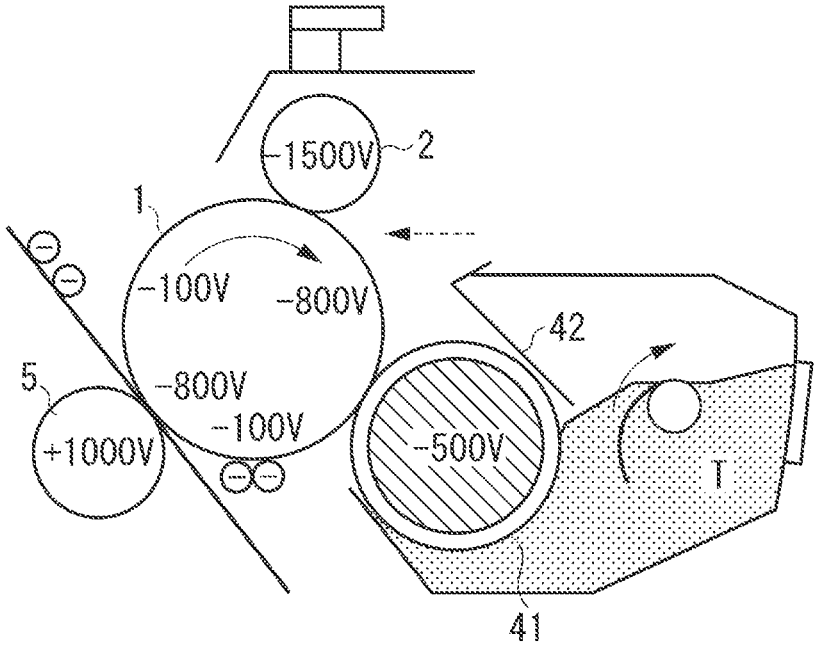
FIG. 9B is a diagram illustrating the image forming operation according to the third exemplary embodiment.

Consequently, in the aforementioned supply operation, a charging bias (Vpri) is desirably set to a discharge start voltage (Vth) or lower. More specifically, a voltage that is not discharged to the image bearing member is desirably applied to the charging member. A sequence performed according to the present exemplary embodiment is illustrated in FIG. 9. In the present exemplary embodiment, a discharge start voltage (Vth) is 600V (Vth=600V). If a charging bias (Vpri) is −500V (i.e., −500V≤Vth), the image bearing member is not charged. Thus, a drum potential (Vd)=0V. Herein, each bias illustrated in FIG. 8 according to the first exemplary embodiment can be changed, for example, as a case "b1" and a case "c1" illustrated in FIG. 10.

The applied bias to the charging member described herein is merely one example. As long as Vpri≤Vth is satisfied, a similar effect can be achieved with any bias.

Moreover, an operation time of the above sequence is desirably longer than a duration of time from when the apparatus starts until a developer or a lubricant reaches the charging roller from the developer bearing member. Then, the operation can be shifted to the supply operation of the first or second exemplary embodiment.

When the image forming apparatus is installed (an initial state), large friction is generated in such a contact-type charging member since there is no developer on a contact surface between the charging member and the image bearing member. If the charging member discharges to the image bearing member, the friction is further increased by the influence exerted by discharge product. In such a state, rotation of the charging member may damage a surface layer of the charging member.

Moreover, in a case where the surface layer of the charging member is damaged, other problems may occur. For example, a charging failure of the image bearing member may occur, and an amount of developer adhering to the surface of the contact-type changing member may be locally changed.

However, the execution of the sequence according to the present exemplary embodiment enables the lubricant to be provided on the contact surface, so that the driving torque for the charging member is reduced. This can reduce an increase in the friction force, thereby reducing the damage to surface layer of the charging member due to the discharge.

According to the exemplary embodiments of the present invention, fluctuations in chargeability in an initial state can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image bearing member configured to bear a developer image;

a charging member configured to contact the image bearing member;

a storage unit configured to store information about the charging member; and a developing unit configured to supply developer having a predetermined polarity to the image bearing member to form a developer image, and to collect developer remaining on the image bearing member after the developer image is transferred, a cartridge configured to be detachable from the image forming apparatus and including at least the image bearing member, the charging member and the storage unit;

wherein, in a case where the charging member is new, a supply operation for supplying developer or lubricant is performed prior to an image forming operation in such a manner that the developer or the lubricant having a polarity different from the predetermined polarity adheres to a surface of the charging member, and wherein, in a case where there is no usage history of the charging member, the supply operation is performed.

2. The image forming apparatus according to claim 1, wherein a circumferential speed of the charging member is higher than that of the image bearing member.

3. The image forming apparatus according to claim 1, wherein, the developing unit includes a developer bearing member configured to bear developer, and wherein the supply operation is performed after the developer bearing member contacts the image bearing member.

4. The image forming apparatus according to claim 1, wherein at least one of temperature information and humidity information of the image forming apparatus is acquired to change an operation time of the supply operation based on the information.

5. The image forming apparatus according to claim 1, wherein in the supply operation, the developer that is caused to adhere to a surface of the charging member is fogging developer.

6. The image forming apparatus according to claim 1, wherein the supply operation is performed in a state where a voltage is not applied to the transfer unit or the transfer unit and the image bearing member are separated.

7. The image forming apparatus according to claim 1, wherein a voltage applied to the charging member in the supply operation is a voltage that is not discharged to the image bearing member.

8. The image forming apparatus according to claim 1, wherein the developer is one component developer.

9. The image forming apparatus according to claim 1, wherein the developer is magnetic developer.

* * * * *